United States Patent [19]

Snow et al.

[11] Patent Number: 4,483,655

[45] Date of Patent: Nov. 20, 1984

[54] VESSEL LOADING METHOD

[75] Inventors: Frederick O. Snow, Wayne; Roger L. Hulette, Sparta, both of N.J.; Albert M. Martinson, Jr., Rose Valley, Pa.; Peter Gwyn, Charleston, S.C.

[73] Assignee: AMCA International Corporation, Hanover, N.H.

[21] Appl. No.: 426,222

[22] Filed: Sep. 28, 1982

[51] Int. Cl.[3] ..... B65G 67/60

[52] U.S. Cl. ..... 414/786; 414/144; 414/145

[58] Field of Search ..... 414/137, 138, 139, 140, 414/144, 145, 786; 198/548, 558

[56] References Cited

U.S. PATENT DOCUMENTS

| | | | |
|---|---|---|---|
| 3,076,565 | 2/1963 | Campbell | 414/139 |
| 3,384,248 | 5/1968 | Leitch et al. | 414/145 |
| 3,420,388 | 1/1969 | Briggs | 414/139 |
| 3,856,159 | 12/1974 | Soros | 414/139 |
| 3,938,676 | 2/1976 | Croese | 414/138 |
| 4,215,965 | 8/1980 | Parsons | 414/138 X |

FOREIGN PATENT DOCUMENTS

| | | | |
|---|---|---|---|
| 2063182 | 6/1981 | United Kingdom | 414/138 |

OTHER PUBLICATIONS

"We Make it Happen", ORBA brochure.

"The Self Unloading Ship", Stephens-Adamson brochure.

"Coal Terminals", Energy Terminals, Inc. brochure.

*Primary Examiner*—Robert J. Spar

*Assistant Examiner*—Ken Muncy

*Attorney, Agent, or Firm*—Burns, Doane, Swecker & Mathis

[57] ABSTRACT

A large cargo vessel is loaded by moving a self-unloading barge alongside and fixing it relative to the vessel. A boom assembly of the barge is slewed into alignment with a hold of the vessel whereupon a shuttle conveyor is extended over the open hold. Bulk material is then unloaded from the barge to the vessel. The boom assembly can be incrementally slewed, luffed, extended and retracted to position cargo in the hold. And, the barge can be repositioned next to the ship without assistance of a tug.

8 Claims, 6 Drawing Figures

VESSEL LOADING METHOD

BACKGROUND OF THE INVENTION

The present invention relates generally to handling of bulk materials. More specifically, the present invention relates to a process for loading a large vessel with bulk material.

In recent years, greater emphasis has been placed on the use of very large cargo vessels for water-borne shipment of bulk materials. Vessels having cargo capacities on the order of 150,000 dead weight tons (DWT) are being used, and are being considered for use, in the transshipment of bulk materials. Many bulk materials are suitable for shipment by water including various ores, minerals, coal, grain, bauxite, phosphate rock, and the like.

One of the important economic considerations in transportation of any bulk material is the speed with which a particular volume of the bulk material can be loaded for transportation, transported and unloaded. This is especially important in the case of railroad transportation and water-borne transportation: in both rail transportation and water-borne transporatation demurrage fees must be paid when the train or ship is not loaded or unloaded within a specified period of time.

As the very large cargo vessels become more frequently used, existing material handling equipment at existing harbor facilities is strained to load or unload a large cargo vessel in the specified period of time. Accordingly, the need exists to develop a material handling system which is compatible with existing dockside facilities but which is also capable of quickly and efficiently loading very large cargo vessels.

A particular industry where the need for high capacity material handling systems has been demonstrated is the coal industry. Coal is enjoying a greater demand than in past years, for example, as a replacement for petroleum fuels in many power plant installations. Accordingly, large quantities of coal must be shipped from the coal fields to various power plant installations. Many of the large coal-producing field lie within a reasonable proximity to northeastern United States seaports. In addition, most coal fields enjoy existing railroad terminal connections directly with those same ports. These facts have caused considerable interest in the use of very large capacity cargo vessels to transport the coal. But, while most of those ports are provided with bulk loading facilities at dockside, most existing piers are incapable of efficiently handling the large capacity cargo vessels now being prepared for use.

The large capacity cargo vessels also experience another problem with the majority of east coast ports. That problem relates to the depth of the water available in those ports. Most each coast ports are themselves fairly shallow and have a water depth on the order of 40 feet. When a very large cargo capacity vessel is fully loaded, however, it may require a draft (water depth) of 50 feet or more. For example, a vessel having a cargo capacity of 150,000 DWT typically would require water depths of 52 to 54 feet. As a result, when a vessel having a cargo capacity of 150,000 DWT or more is employed in the shipment of bulk materials, that vessel cannot be fully loaded at the pier in most east coast ports.

Thus, the need exists for both methods and apparatus to facilitate the use of large cargo capacity shipping vessels while using the existing port facilities. Moreover the need continues to exist for minimizing capital costs while improving the cargo handling capacity of ports.

In the past, there have been some efforts to improve the bulk material handling capacity of ports. Among these efforts has been the use of self unloading vessels. Much of this effort has been centered in the Great Lakes area. Typically, a self unloading vessel has a slewable, luffable boom or has a shuttle boom. In either case, the boom itself includes a conveyor system. Generally one or more unloading conveyors run longitudinally beneath one or more cargo storage holds along the keel of the vessel. Each cargo storage hold is typically provided with gates to control the flow of material to the unloading conveyor(s). Generally the longitudinal conveyor communicates with an elevating conveyor which raises the bulk material to a deck level boom conveyor and discharges it onto the boom conveyor for off loading.

The boom of such unloading vessels is normally intended to off load onto a shore facility which is fairly low in comparison to the vessel itself. As a result, self unloading vessels cannot discharge material into the hatches of large capacity vessels which could be 40 feet or more above the deck of the self-unloading vessel when it is located alongside the large vessel. Another limiting aspect of the self unloading vessel is the positioning of the unloading conveyor(s) along the vessel keel. With such positioning of the longitudinal conveyor(s), the cargo hold must be provided with inclined sides at the bottom in order to allow gravity feed of the bulk material through gates to the unloading conveyor(s). Thus a considerable cargo volume is lost between the inclined sides and the hull resulting in wasted cargo capacity. Moreover, the center of gravity of the cargo is elevated since potential lower cargo space is wasted.

It has also been proposed to top off large cargo vessels from barges after partial loading at a conventional pier. But, this method appears to be limited in terms of vessel size. Many pier facilities use gravity feed systems. As a result the higher freeboard associated with large cargo vessels reduces the pitch of gravity system feed chutes thus interfering with gravity induced flows. And in any event, the vessel must later be topped off. Also, existing piers are not designed to accept the forces imposed by the docking of the large vessels.

One effort to enhance the removal of bulk material from the bottom of a cargo hold includes the use of a rotatable screw which is located at the bottom of the hold with its axis positioned transversely of the vessel and parallel to the bottom of the hold. The screw is rotated and simultaneously translated along the bottom of the hold. The direction of translation is perpendicular to the axis of the screw and in the direction of the longitudinal dimension of the vessel. This translating screw moves material from the bottom of the hold to a conveyor which is positioned to one side of the vessel. In addition, gates are required to contain the bulk material when the vessel is in transit. These existing translating screw installations exert very high thrust forces on the vessel that are unbalanced, suffer from complexity in the opening and closing of gates at the bottom of the hold and have a conveyor to which access for inspection and repair is difficult.

SUMMARY OF THE INVENTION

According to the present invention, the inadequacies and problems with existing bulk material shipment facilities and loading methods are overcome enabling the efficient use of large cargo vessels to ship those materials. In this connection, the invention contemplates mooring of a large cargo vessel in deep water rather than docking the vessel at a shallow draft pier. In this way, the required water depth for the fully loaded vessel can be easily attained. As a result, the limitations of existing ports in terms of water depth are obviated.

Typically the large cargo vessel will be moored by a single point permitting the vessel as well as an adjacent barge to adjust to a prevailing wind and current conditions. This arrangement also facilitates bringing the barge along side the ship and considerably reduces the possibility of collisions there-between.

To load the large vessel, a self unloading barge is provided which is moved alongside the large vessel and secured to the large vessel by suitable mooring lines. A slewable, luffable boom carriage having a shuttle conveyor therein is mounted on an elevated platform of the barge. Thus the shuttle conveyor is able to clear the high freeboard existing when the cargo vessel is empty and the outboard end of the conveyor can be manipulated around deck structures of the cargo vessel.

The boom is then slewed into position in general alignment with the cargo hold to be filled. Next, the shuttle conveyor is extended to bring its outboard end into position above the open hold. At that time the barge unloading commences with bulk material being delivered from barge holds to a longitudinal conveyor which feeds an elevating conveyor that, in turn, subsequently feeds the shuttle conveyor of the boom.

In order to fill a second hold of the large vessel from the barge, the barge is repositioned relative to the cargo vessel. In this connection, the barge can be winched along the cargo vessel until the boom carriage is in general alignment with the next hold to be filled. At that point the shuttle conveyor is again extended into position over the hold and the unloading of the barge continues. This manipulation of the barge relative to the vessel can be done without the assistance of a tug or other tending vessel for the barge.

Since large cargo vessels have, of course, large holds and large hatches, it is desirable to distribute the bulk material to different parts of the hold when the hatches are open. To this end, the boom assembly of the unloading barge is capable of both slewing, luffing and extending. In this manner, material can be moved to different parts of the hold during the barge unloading vessel-loading operation.

BRIEF DESCRIPTION OF THE DRAWINGS

Many objects and advantages of the present invention will be apparent to those skilled in the art when the specification is read in conjunction with the attached drawings wherein like reference numerals have been applied to like elements and wherein.

DESCRIPTION OF THE PREFERRED EMBODIMENT

Figure 1:
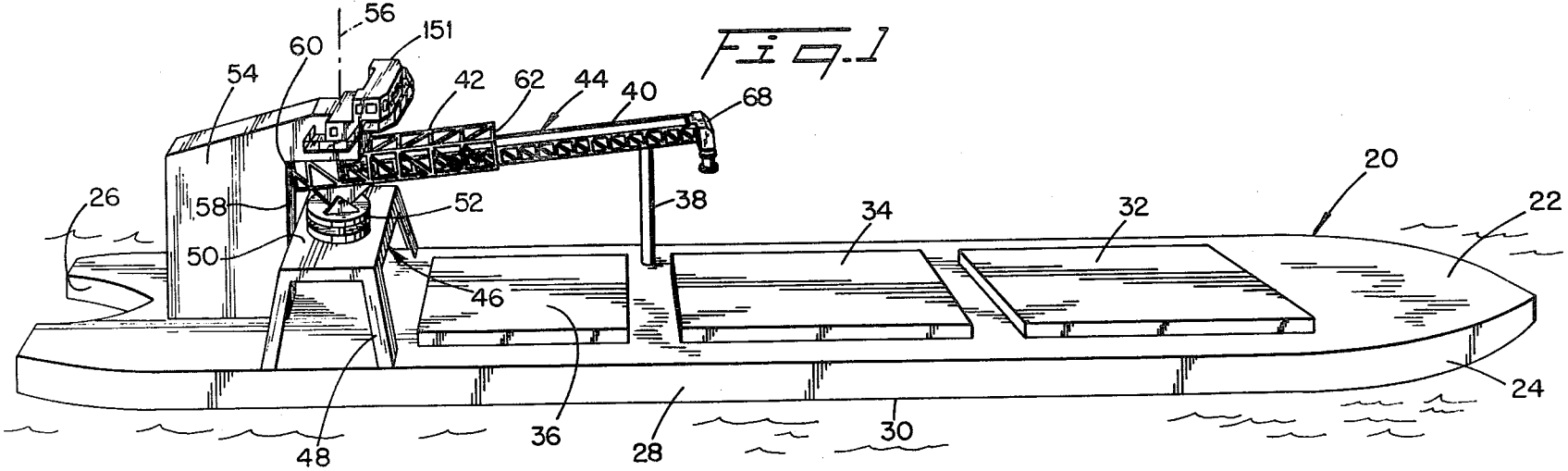
FIG. 1 is a perspective view of a barge according to the present invention.

Turning now to FIG. 1, a self unloading barge 20 has a deck 22 carried on a hull 24. The barge 20 itself is not self-propelled but is suitable for use in practicing this invention. At the stern portion of the hull 24, a recess 26 is provided which is designed to accommodate the bow of a tug or other self-propelled tending vessel. Such a tug or tender (not illustrated in FIG. 1) is needed to propel the barge and must have adequate power to perform that function. Suitable conventional bollards, cleats and winches are provided on the deck 22 and on the transom 27 of the barge to hold the barge and the tug in operative relationship to one another, using conventional rigging from the tug boat.

The hull 24 has sides 28 which extend generally vertically upward from the waterline 30 to the sheer (i.e. edge) of the deck 22. This distance is commonly referred to as the freeboard of the barge. It will be clear that as the amount of cargo loaded in the barge varies, the amount of freeboard also varies. Specifically, when the barge is fully loaded, the freeboard has a minimum value whereas when the barge is empty, the freeboard has a maximum value. Stated differently, when the barge is empty, it sits higher in the water than it does when the barge is fully loaded.

The deck 22 of the barge 20 has one or more cargo hatches 32, 34, 36 each of which may or may not have a corresponding hatch cover. Preferably, the cargo capacity of the cargo holds in the barge 20 is on the order of 30,000 DWT.

Extending above the deck 22 between the hatches 34, 36 is a boom rest 38. The boom rest 38 is generally in the shape of a pipe column and is rigidly secured to the barge deck 22. Alternately, the boom rest might be an extension of a bridge crane used to lift and stow hatch covers. The boom rest 38 may include a horizontal portion provided with a centrally disposed notch (not visible in FIG. 1) which receives the lower portion of a boom assembly 44. When the boom assembly includes a shuttle conveyor 40 carried by the boom carriage 42, the lower portion of the shuttle conveyor 40 is supported. The top of the boom rest 38 which supports the boom assembly may be about 40 feet above the deck 22 in order to hold the boom assembly approximately level. The notch is effective to resist side-to-side movement of the boom assembly 44 when the barge is under way. The boom rest 38 is preferably located at one side of the barge 22 so that the boom does not restrict visibility of the pilot while the barge is underway or is being maneuvered.

Toward the stern portion of the barge 20 and mounted on the deck 22 is boom support means 46. The boom support means 46 is positioned behind the third hatch 36 and includes a generally horizontal platform 50. Each of four legs 48 is secured to the deck 22 at its lower end and to the platform 50 at its upper end. These legs 48 are inclined toward one another in the vertically upward direction to enhance rigidity of the platform 50. The platform 50 of the boom support means provides a mounting surface for a boom bearing assembly 52 to which the boom carriage 42 of the boom assembly 44 is connected. As an example of the dimensions of the boom support means 46, the platform 50 may be positioned at an elevation of about 35 feet above the deck 22 with the bottom of the boom assembly 44 at an elevation of about 40 feet above the deck 22.

The boom bearing assembly 52 pivotally mounts the boom assembly 44 and allows the boom assembly to slew through a horizontal arc of about 260°, 130° to each side of the longitudinal center line of the barge 20. In addition, the bearing assembly 52 pivotally mounts the boom assembly 44 for luffing through an angle of about 10° above the horizontal. A luffing cylinder 53 controls the luffing movement of the boom assembly. The slewing and luffing ability of the boom assembly 44 allows the boom assembly to offload bulk material either onto a larger adjacent floating cargo ship or onto an adjacent pier. The luffing capability enables the boom to be directed over the deck sheer or hatch coaming of a larger vessel when the deck or hatch coaming is at an elevation above the bottom of the boom assembly 44.

The boom support means 46 is designed so that the height of the platform 50 is sufficient to position the bottom of the boom assembly 44 at a sufficient elevation that it will clear the deck and hatch coamings of an adjacent large cargo vessel when the barge is full and the cargo ship is empty. In this manner, the barge can be used to load either an empty cargo vessel or to top off the cargo load of a partially loaded cargo vessel.

Typical freeboard variations for a 30,000 DWT self unloading barge range from 15 feet when fully loaded to 40 feet when completely empty. Conversely, the freeboard variations of a 150,000 DWT ship range from 26 feet fully loaded to 55 feet when empty. Thus a height of about 40 feet from the deck 22 to the boom assembly 44 will usually be adequate to offload from the barge to the cargo vessel.

At the stern of the barge 20 between the support platform 46 and the recess 26 is a superstructure 54 which encloses the upper portion of an elevating conveyor system for removing bulk material from the barge 20. Preferably the superstructure 54 is located on the longitudinal centerline of the barge 20. The superstructure 54 extends forwardly above the boom carriage 42 and forwardly of the vertical axis 56 about which the boom carriage 42 is slewable. The forward projection of the superstructure 54 above the boom assembly 44 creates a recess 58 which accommodates the back end 60 of the boom carriage 42.

The outboard end 62 (see FIG. 6) of the boom carriage is in general vertical alignment with the side 28 of the barge hull 24. Preferably, the outboard end 62 of the boom carriage 42 does not extend beyond the barge side 28 by a distance greater than the width of a conventional fender 64. But in some instances, the end 62 may be above the width of a deck around the cargo hatch of the large vessel 150.

The shuttle conveyor 40 has a suitable conventional telescopic chute 68 at its outboard end 66. The chute 68 is used to direct bulk material vertically downwardly from the conveyor 70 carried on the shuttle conveyor 40 into the hold of a larger vessel or onto a bulk material handling device. To allow flexibility in the discharge position of the chute 68, the shuttle conveyor 40 is retractable and extendable longitudinally with respect to the boom carriage 42 between an extended position (illustrated by solid lines in FIG. 6) and a retracted position 72 (illustrated by broken lines in FIG. 6). It will be seen that the telescopic chute 68 can be retracted to the outboard end 62 of the boom carriage 42. In this fashion, the retracted position of the chute 68 defines the radial clearance necessary to slew and luff and boom assembly 44. Since the telescopic chute provides an enclosed delivery of bulk material from the shuttle conveyor to the hatch of a large vessel, the chute 68 substantially eliminates atmospheric pollution by dust from the bulk material.

Figure 2:
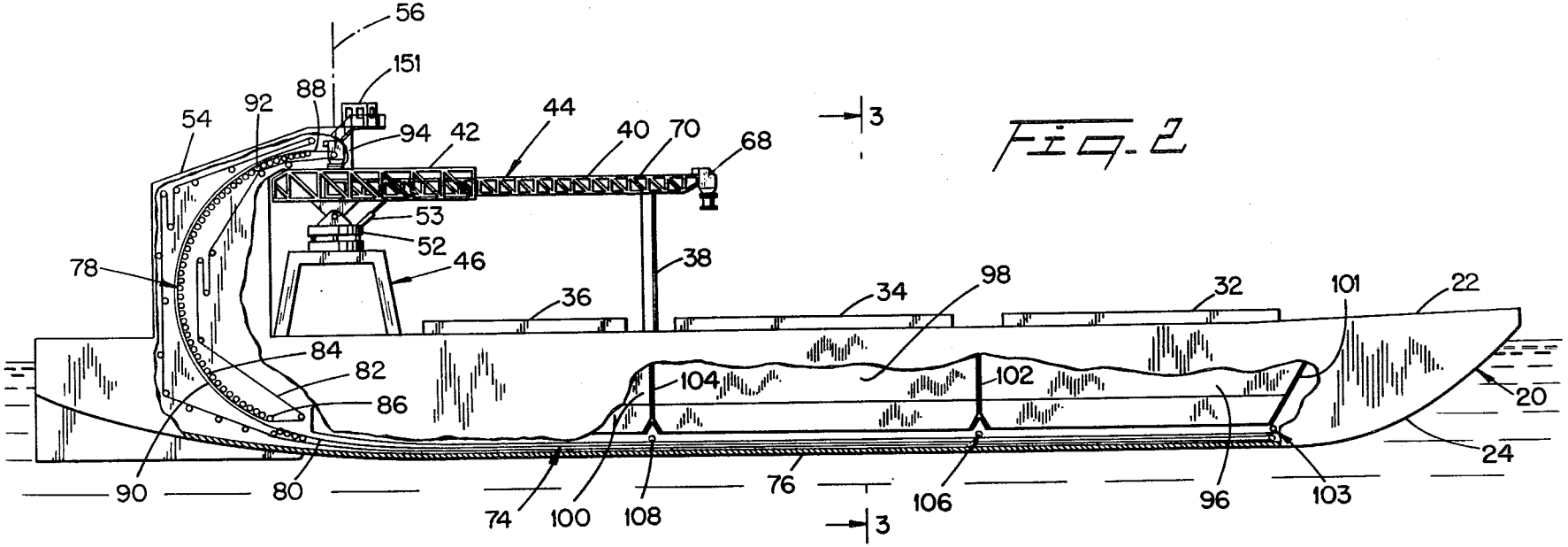
FIG. 2 is an elevational view with portions broken away to illustrate the conveyor of the barge in the present invention.

The elevating conveyor system 78 (see FIG. 2) for raising bulk material from the bottom of the hull 24 through the superstructure 54 to the boom assembly 44 is illustrated schematically in FIG. 2. Portions of the superstructure 54 and the hull 24 are broken away to illustrate more clearly the mechanism whereby the bulk material is elevated. In this connection, it will be observed that a longitudinal conveyor system 74 extends longitudinally along the centerline of the barge 20 and is positioned closely adjacent to and just above the keel 76. This longitudinal conveyor 74 extends from the bow of the barge (in front of the first storage hold 96) to an elevating conveyor assembly 78 and delivers material to the elevating conveyor assembly 78.

In the elevating conveyor system 78, a first conveyor 80 receives material directly from the longitudinal conveyor 74. In fact, if desired, the first elevator conveyor 80 could be an extension of the longitudinal conveyor 74 and may use the same conveyor belt. A second elevating conveyor 82 is also part of the elevating conveyor means 78 and has a curved portion 82 which extends from a point 86 near the keel 76 to a point 88 which is located near tne centerline 56 above the boom assembly 44. This curved conveyor portion 84 cooperates with a conformingly curved portion 90 of the first elevator conveyor 80. Throughout the curved portions 84, 90, of the first and second elevating conveyors 80, 82, the flexible conveyor belts are in cooperating relationship with one another so that the bulk material being conveyed between the conveyors is essentially trapped therebetween. Accordingly, the bulk material is elevated through the curved portions 84, 90, and transferred from the first elevating conveyor 80 to the second elevating conveyor 82. Thus, at the discharge point 88, the bulk material is supported entirely by the second elevating conveyor 82.

The curved portions 84, 90 of the first and second elevating conveyors separate from one another at a point 92 which is at an elevation above the boom assembly 44. Typically this point 92 is located such that the bulk material being unloaded from the barge 20 can be supported by the underlying second elevating conveyor 82 without sliding backwardly. This general type of elevating conveyor system is available commercially from Stephens-Adamson of Aurora, Ill.

Bulk material from the second elevating conveyor 82 is discharged at its end 88 into a chute 94 which is preferably centered on the axis 56 about which the boom assembly 44 is slewable. In this fashion, as the bulk material passes through the chute 94 it is deposited directly on the upper surface of the conveyor 70 carried by the shuttle conveyor 40 regardless of the position of the boom assembly 44. Bulk material is then carried by the conveyor 70 of the shuttle conveyor assembly 40 to the telescopic chute 68 positioned at the outboard end of the shuttle conveyor assembly 40.

As noted earlier, the bulk material carried by the barge 20 is retained in storage holds 96, 98, 100 in the hull 24. Each of these storage holds 96, 98, 100, is located below a corresponding one of the hatches 32, 34, 36 each of which may be fitted with water tight hatch covers for ocean service. Each hold is defined in part by bulkheads extending transversely across the hull 24. More particularly, a bulkhead 102 extends transversely across the hull 24 and is connected thereto so as to separate the storage holds 96, 98. Similarly, a second transversely extending bulkhead 104 is attached at each end of the hull 24 and separates the storage hold 98 from the storage hold 100. A bulkhead 101 extends transversely across the hull 24 and is connected thereto so as to form the forward end of hold 96.

Each of the hold separating bulkheads 102, 104, is provided at its lower end with a pair of splayed walls which are convergent in a vertically upward direction. Positioned beneath each of these bulkheads 101, 102, 104, is a corresponding unloading assembly 103, 106, 108. The unloading assemblies 103, 106, 108, illustrated in FIG. 2 are each in a parked, or stowed position for the unloading assembly 103, 106, 108. When the barge is actually being unloaded, the assemblies 103, 106, 108 traverse the bottom of the holds being unloaded and auger material toward the longitudinal conveyor 74.

The unloading assembly 106 is illustrated in greater detail in FIG. 3 where it can be seen in position below the splayed walls 110 of the bulkhead 102 at the forward end of the hold 98. It will also be seen from FIG. 3 that along each side wall of the hold 98 an inclined wall surface 112, 114, is provided. The inclined surfaces 112, 114 have an angle with respect to the horizontal which exceeds the natural angle of repose for bulk materials to be carried by the barge 20. In this fashion, there will be no dead spots in the bulk material during the unloading process. In this connection, the splayed walls such as 110 are also inclined at a similar angle. The inclination of the side walls 112, 114, defines a suitable area for mechanical equipment used to operate the unloading assembly 106 as well as the other unloading assemblies 103, 108 (not illustrated) in FIG. 3.

Each unloading assembly 106 includes a pair of augers 116, 118. Each auger 116, 118 has a longitudinally extending axis that extends from a point beneath the corresponding sloped side wall 112, 114 to a point adjacent the center of the corresponding hold. Extending from the outboard end of each auger 116, 118 toward the center of the hold 98 is a helical flight. Each helical flight wraps the auger in a direction such that rotation of the auger will move material toward the center of the corresponding hold 98. In this fashion, as the augers 118, 119 rotate, material will be moved by the auger from both sides of the hold 98 toward the center of the hold.

Figure 3:
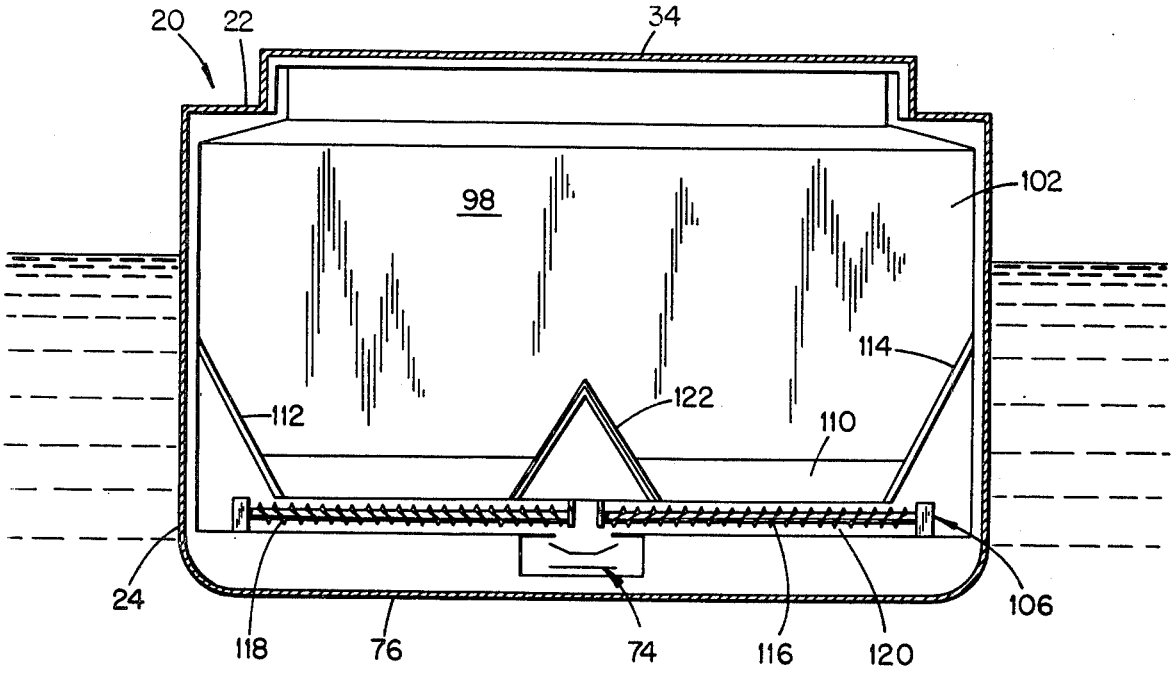
FIG. 3 is an enlarged cross-sectional view taken along the line 3—3 of FIG. 2.

It will also be seen from FIG. 3 that the longitudinal conveyor 74 is perpendicular to the augers 116, 118 and is positioned directly beneath the center of the hold 98. In this manner, as the augers rotate the bulk material conveyed by each auger is moved directly to the upper run of the longitudinal conveyor 74 which then moves the material to the elevating conveyor 78 for subsequent unloading from the barge.

Positioned directly above the longitudinal conveyor 74 and above the augers 116, 118 is a longitudinally extending canopy 122. The canopy 122 extends throughout the entire longitudinal length of the hold 98. In addition, a similar canopy in general longitudinal alignment with the canopy 122 extends throughout the entire length of each hold in the barge 20 so that the longitudinal conveyor 74 is shielded from the weight of bulk material in the hold. Like the side walls 112, 114, the canopy 122 has side surfaces that are inclined at an angle exceeding the natural angle of repose of bulk material to be carried by the barge 20. Thus, the bulk material will not hang up along the surfaces of the canopy 122.

Figure 4:
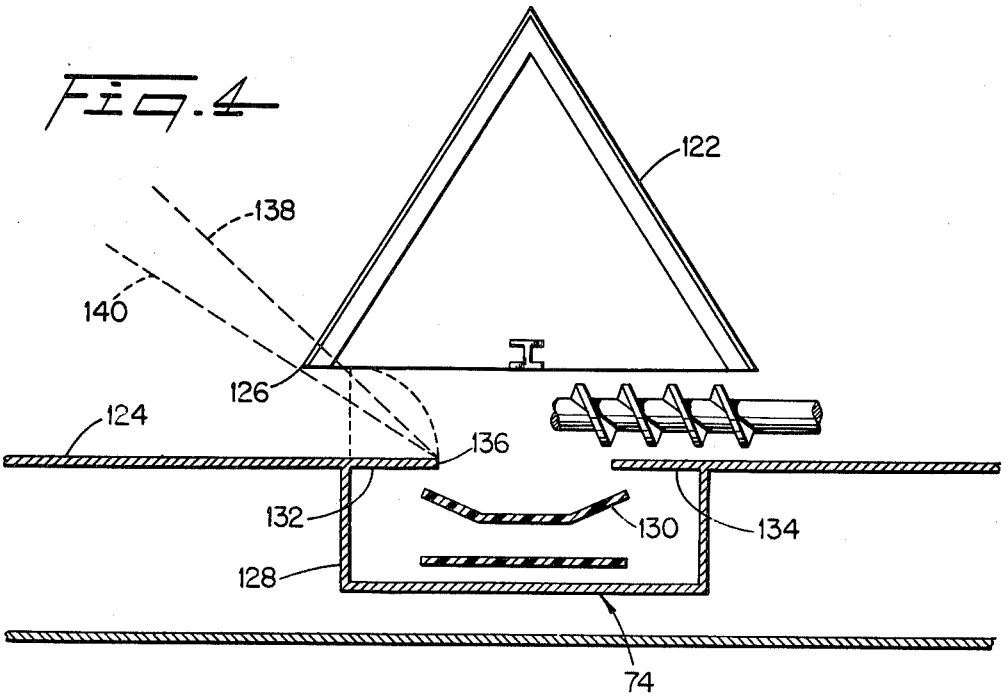
FIG. 4 is further enlarged cross sectional view with portions removed showing details of the conveyor positioning.

The floor 124 (see FIG. 4) of the hold extends to a lateral position beneath the lower edge 126 of the canopy 122. The floor 124 also connects with a housing 128 for the longitudinal conveyor 74. So that bulk material will be deposited directly on the upper run 130 of the longitudinal conveyor 74, a shelf 132, 134, is provided on each side of the longitudinal conveyor housing 128. Each shelf 132, 134, is hingedly connected so as to be movable between the horizontal position (as illustrated in solid lines), and a vertical position (as illustrated in broken lines). In this fashion, the shelf 132, 134 can be rotated to its vertical position in order to inspect or repair the conveyor 74. Naturally, when such inspection or repair is taking place, the augers 116, 118 are parked in their position beneath the bulkhead and no material is in the hold. The shelves 132, 134, extend essentially the entire distance between the respective bulkheads.

The unloading augers and the canopy 122 make it possible to avoid the use of gates at the bottom of the hold to contain bulk material against spillage into the longitudinal conveyor housing 128. To accomplish this objective, the edge 126 of the canopy 122 is positioned so that a straight line 140 connecting the edge 126 with the free end 136 of the underlying shelf 132 lies at a predetermined angle to the horizontal defined by the floor 124 of the hold. The angle between the line connecting the edge 126 and the edge 136 is less than the natural angle of repose for the bulk material to be carried by the barge 20. For example, the line 138 defines an angle with the horizontal direction defined by the floor 124 which corresponds generally to the natural angle of repose for a material such as coal, approximately 37°. The angle between the line 138 and the line 140 which connects edges 126, 136, is the maximum angle of list expected for the barge. Typically, this maximum angle of list is about 15°. Accordingly, even if the vessel lists to the maximum extent anticipated, the bulk material retained above the canopy will not slide off the edge 136 and onto the upper run 130 of the conveyor. For ocean going barges subject to even greater angles of heel, closure plates may be provided as restraining gates at the bottom of longitudinal canopies.

Each auger 116, 118 (see FIG. 3) is provided with a suitable conventional drive means. The drive means both rotates the auger to cause material to move toward the center of the barge 20 but also causes the auger 116, 118 to translate along the bottom of the hold. In this connection, the auger translates in a direction perpendicular to the axis of the auger and parallel to the keel 76 of the hull 24. The augers 116, 118 and the drive mechanisms therefor are commercially available equipment as manufactured by C. J. Wennberg, Inc. of Smyna, Ga.

It will be noted that the use of the auger 116, 118 for the unloading purposes allows a considerably greater distance to be provided between the sloped walls of the canopy 122 and the sloping side walls 112, 114 in the hold than could be obtained with a gate arrangement. With this new arrangement, the hold 98 can be positioned at a lower level in the barge 20 adding to stability of the barge itself. In the past, such positioning of the cargo hold was not available because the unloading conveyor 74 had to be coextensive with the gate openings at the bottom of the hold. As a result, the convergently sloping side walls extended for greater vertical distance placing the center of gravity higher in the vessel and causing greater wasted space between the side walls and the hull.

The method of using the self-unloading barge described hereinabove to transport bulk material from a loading area, such as a pier, to an unloading area, such as a moored transport vessel, and to load a large (for example, 150,000 DWT) transport vessel will now be described.

Figure 5:
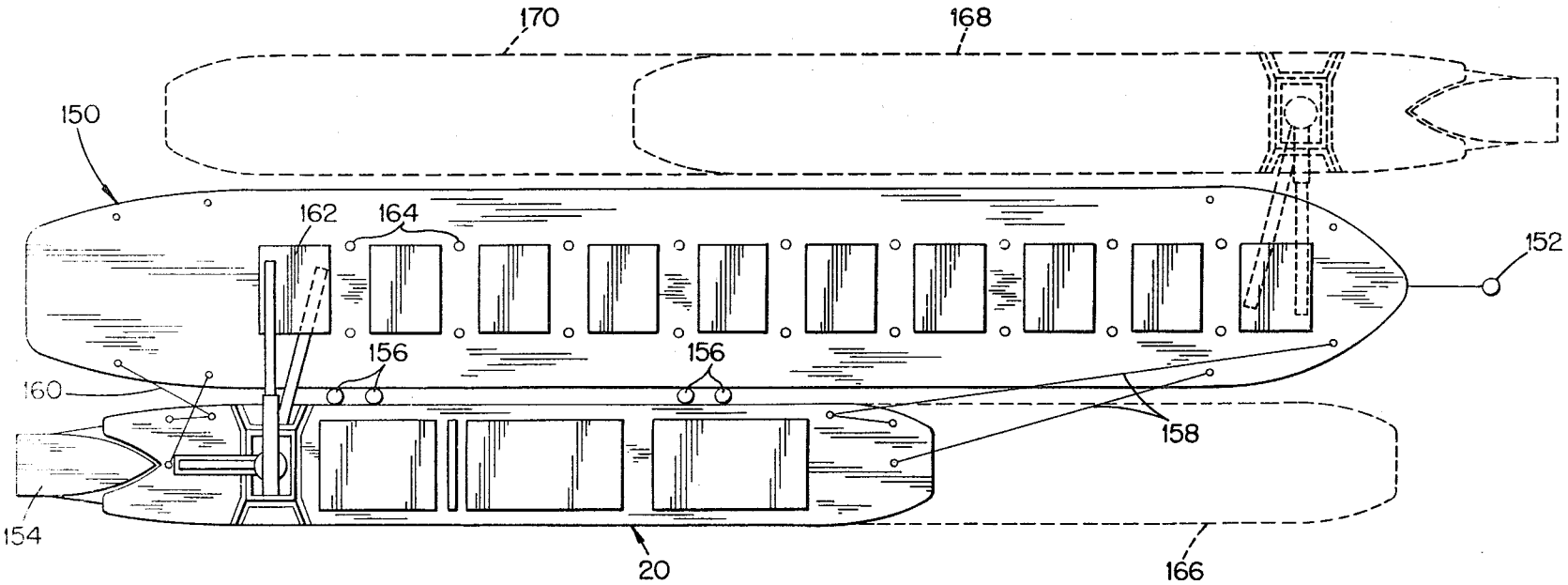
FIG. 5 is a schematic plan view of the self unloading barge adjacent a large cargo vessel.

Turning to FIG. 5, a large ship or vessel 150 having a cargo capacity of 150,000 DWT is illustrated. The vessel 150 is moored or anchored by a single point mooring 152. This single point mooring at the bow of the vessel 150 enables the vessel 150 to adjust naturally to the effect of wind, waves and currents. To load the vessel 150, the barge 20, which is propelled by a suitable conventional tug or tender 154, is moved into position alongside the vessel 150.

In moving the barge from a loading pier to the moored vessel, the barge/tug assembly can be piloted and controlled completely from a pilot house 151 mounted on top of the superstructure 54. This pilot house location permits the best visibility for the pilot himself. From the pilot house, the pilot can control all operation of the tug including power and direction. Moreover, the pilot has complete access to communications from the pilot house.

Suitable fenders 156 are positioned between the barge 20 and the vessel 150 in order to prevent damage to the two vessels during the loading operation. The barge 20 is positioned relative to the ship 150 such that the axis 56 is abreast of a selected cargo hold 162 of the ship. The barge 20 is fixed to the ship 150 by a plurality of mooring lines 158 at the bow of the barge 20 and by a plurality of mooring lines 160 at the stern of the barge 20. Suitable cleats, bollards and winches are provided on the vessel 150 and the barge 120 to handle the mooring lines 158, 160.

The boom assembly 44 is then moved from its stowed position (see FIG. 1) toward the cargo vessel 150. All controls for barge unloading operations are also located in the pilot house 151. For example, the boom luffing controls, boom slewing controls, shuttle conveyor controls, and conveyor system controls are all provided at the operators station in the pilot house 151.

Initially, (see FIG. 6) the shuttle conveyor 40 is retracted into the boom carriage 42 so that the back end of the shuttle conveyor 40 projects beyond the barge 20 as shown at 72. In this fashion, the boom housing 42 can be directed toward, and generally aligned with, a selected cargo hold 162 (see FIG. 6) of the vessel 150. With the shuttle conveyor 40 retracted, the end of the boom housing 42 and, for that matter, the end of the entire boom assembly 44 will clear the masts 164 which may be carried on the deck of the cargo vessel 150.

When the boom housing 42 has been slewed to a position in general horizontal alignment with the hatch 162 to be filled or loaded, the shuttle conveyor 40 is luffed and extended until the telescopic chute 68 provided at the end thereof is centrally positioned above the open hatch 162. The telescopic chute 68 is then lowered until the bottom or discharge end is below the hatch coaming.

With the end of the boom assembly 44 thus positioned, the conveyor systems of the unloading barge are started. In addition, the unloading assemblies 103, 106, 108 are moved aft out of their respective parked positions beneath the respective bulkheads 101, 102, 104 (see FIG. 2) and into the cargo holds. In order to move the unloading means 103, 106, 108, the augers 116, 118 (see FIG. 3) begin their rotary operation. The augers are then moved aft across the bottom of their respective holds and draw the material transversely of the barge 20 toward the longitudinal conveyor 74.

When the material reaches the area beneath the canopy 122, it is deposited on the upper run of the longitudinal conveyor 74 which carries the bulk material aft along the bottom of the barge 20 (see FIG. 2) where it is elevated by the first and second elevating conveyors 82, 80 and deposited in the chute 94 above the boom assembly 44. Thereupon, the bulk material passes from the chute 94 onto the conveyor 70 of the shuttle conveyor 40 and is delivered to the telescopic chute 68 (see FIG. 6) which has been positioned above the open hatch of the vessel 150 being loaded. Bulk material drops through the chute 68 down into the hold of the vessel.

Initially, the telescopic chute 68 is positioned approximately at the center of the hold being filled. As the barge unloading process continues, however, the end of the boom assembly 44 (see FIG. 5) can be incrementally slewed so as to move the discharge chute 68 fore and aft within the limits of the hatch opening 162. In this manner, material can be offloaded from the barge and positioned longitudinally within the hold of the vessel 150. In addition, the shuttle conveyor 40 can be incrementally extended or retracted so as to deposit the bulk material side to side in the hold of the vessel being loaded. With this ability to manipulate the end of the boom assembly 44, it will be appreciated that the bulk material can be deposited in the hold of the larger vessel in a manner which is designed to minimize any shifting of the cargo during listing movements of the vessel while under way.

When one hold of the vessel has been filled, the rotary and horizontal operations of the augers 116, 118 are stopped, the telescopic chute 68 is raised and the shuttle conveyor 40 is retracted (see FIG. 6) so that the telescopic chute 68 carried at the end thereof is close enough to the barge 20 that it will clear the masts 164 (see FIG. 5) of the cargo booms carried by the vessel 150. The barge can then be repositioned alongside the vessel 150. This shifting movement can occur any place alongside the ship 150 and approximate limits of the repositioning movement are illustrated by the broken line 166 of FIG. 5. Generally, the barge 20 will load the cargo hatches closer to the stern of the cargo vessel when the barge is headed in the same direction as the cargo vessel. Conversely, as illustrated by broken lines 168, 170, the barge 20 will be directed oppositely to the direction of the vessel 150 when the forward hatches and holds are being loaded. It should be noted at this point, however, that the barge 20 can load both forward and aft hatches of the vessel 150 from the same side of the vessel due to the ability of the boom assembly 44 to slew through the same angle on each side of the barge 20.

Repositioning of the barge 20 relative to the vessel 150 is accomplished by winching the barge along the vessel with the shuttle conveyor 40 retracted to clear the vessel's masts and deck structures. The winches are attached to the cables 158, 160 and are preferably located on the barge 20 itself. Generally, the forward cables 158 are winched in while the rear cables 160 are payed out under tension. As the barge 20 shifts relative to the vessel 150, the boom assembly 44 will come into general lateral alignment with the next hold to be filled. At this point, the shuttle conveyor will again be extended so as to be in general vertical alignment with the center of the hold and the telescopic chute lowered. Next, the rotary and horizontal operations of the augers are started again to offload material and fill the hold of the vessel. It should be noted that the barge 20 can be repositioned without the assistance of a tug or tender in the manner described above, or with the slewing, extending and retracting ability, the barge can load more than one hatch from one position before it becomes necessary to reposition the barge 20 to reach hatches beyond the sweep of the shuttle boom conveyor 40.

Figure 6:
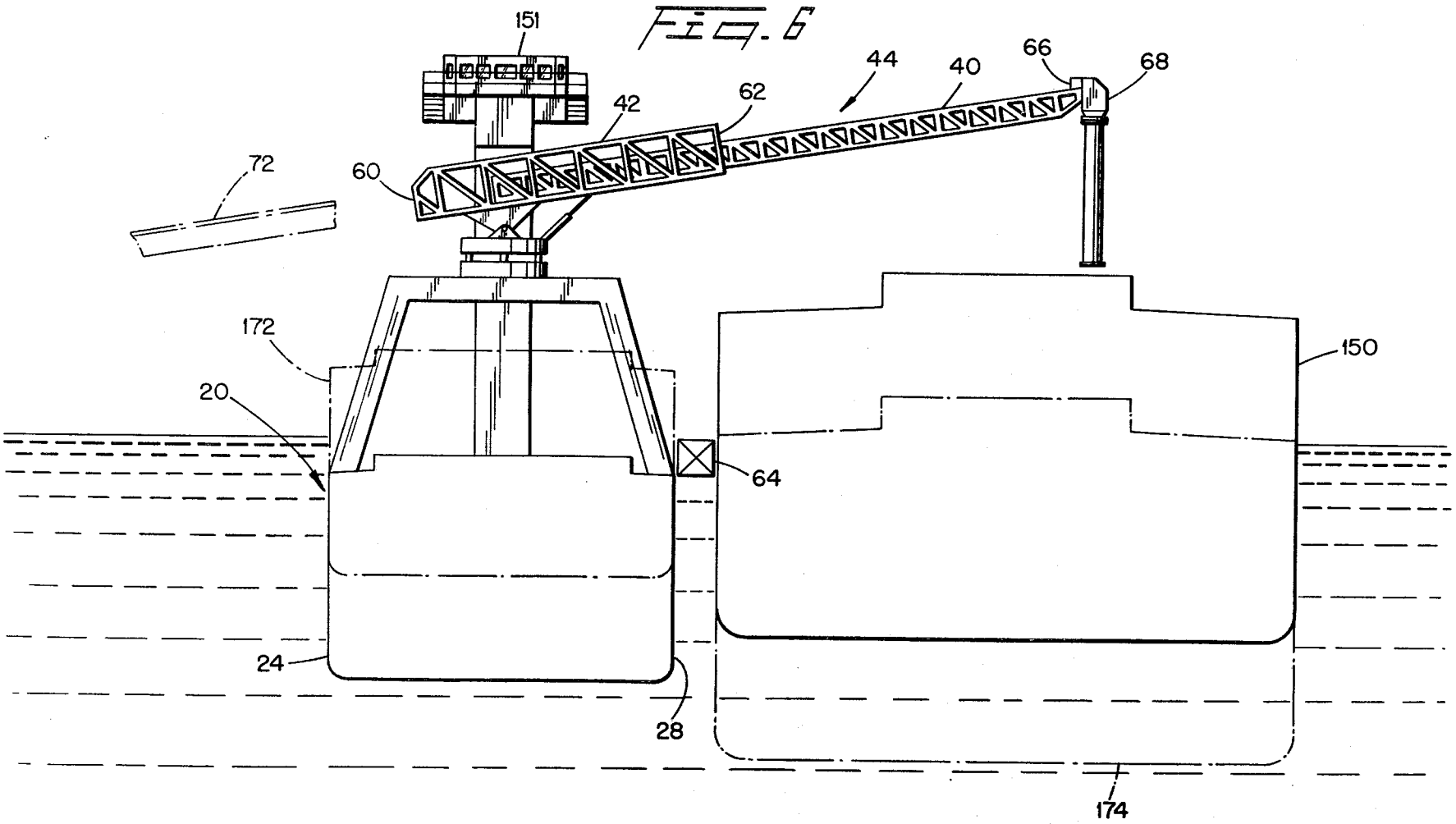
FIG. 6 is a schematic elevational view to illustrate the barge unloading operation.

During the barge unloading operation described above, the barge 20 will rise in the water to the position illustrated by broken lines 172 in FIG. 6. Simultaneously, the vessel 150, since it is being loaded, will settle down in the water from the position illustrated by solid lines in FIG. 6 toward the position illustrated by broken lines 174.

Due to the relative cargo capacities of the barge 20 (approximately 30,000 DWT) and that of the vessel (150,000 DWT) several trips of the barge will be necessary in order to load a vessel 150. It is, of course, possible to use two barges simultaneously, one on each side of the vessel to load the vessel's hatches in any prescribed sequence. During the changes in buoyancy of the barge 20 and the vessel 150 (see FIG. 6) the boom assembly 44 may be luffed downwardly toward the horizontal. The telescopic chute 68 is extensible in the vertically downward direction so as to direct the bulk material more efficiently into the open hold.

Self-unloading barges such as those described in detail above may also be used to top off a cargo vessel 150 which has been partially loaded at a pier. In this event, fewer trips of the self-unloading barge 20 would be necessary. Of course, larger barges will decrease the number of trips required to load the same size vessel 150.

It should now be apparent that a method of loading those large cargo capacity vessels using such a self-unloading barge has been described in detail. Moreover, it will be apparent to those skilled in the art that there are numerous modifications, variations, substitutions and equivalents for the steps of the method described herein. Accordingly, it is expressly intended that all such modifications, variations, substitutions and equivalents that are encompassed by the appended claims be embraced thereby.

What is claimed is:

1. A method of loading bulk material from a barge adapted to be propelled by a self-propelled tending vessel for loading such material on an anchorable transport vessel having a cargo hold, the method comprising the steps of:

positioning the transport vessel and the barge adjacent one another, the barge including a slewable boom and shuttle conveyor, the boom having an outboard end which projects only to substantially the side of the barge in any slewed position of the boom;

fixing the position of the barge and the transport vessel relative to one another;

slewing the end of the boom toward the cargo hold of the transport vessel from a storage position in a generally longitudinal alignment with the barge to a position so that the boom length is in substantially longitudinal alignment with a transverse width of the transport vessel;

extending the shuttle conveyor from the boom end from a retracted position that defines radial clearance for allowing slewing and luffing of the boom so that the outboard end of the shuttle conveyor is above the cargo hold of the transport vessel; and offloading bulk material from the barge to the cargo hold of the transport vessel.

2. The loading method of claim 1 further including the preliminary step of anchoring the vessel with a single point mooring so that the vessel is free to adjust to wind and wave conditions.

3. The loading method of claim 1 including the step of repositioning the barge relative to the vessel when the cargo hold is full to load a second cargo hold.

4. The loading method of claim 3 wherein the repositioning step includes the steps of:

retracting the shuttle conveyor to a position in general vertical alignment with the side of the barge;

shifting the barge to a new position alongside the vessel where the longitudinal length of the boom is in generally transverse alignment with a second hold;

extending the shuttle conveyor from the boom so that the outboard end of the shuttle conveyor is above the second cargo hold; and offloading bulk material from the barge to the second cargo hold.

5. The loading method of claim 3 wherein the repositioning step includes the step of winching the barge along the vessel from a first position for loading the first cargo hold to a second position for loading the second cargo hold.

6. The loading method of claim 1 including the step of luffing the boom as the bulk material is transferred to the vessel to accommodate changes in buoyancy of the barge and the vessel.

7. The loading method of claim 1 wherein the offloading step includes incremental slewing of the boom to direct bulk material to different parts of the cargo hold.

8. The loading method of claim 1 wherein the offloading step includes extending and retracting the shuttle conveyor, incrementally to direct the bulk material to different parts of the cargo hold.

* * * * *